US009498105B2

(12) United States Patent
McLaughlin et al.

(10) Patent No.: US 9,498,105 B2
(45) Date of Patent: Nov. 22, 2016

(54) ANTI-SLIP SHOE ACCESSORY FOR COURT SPORTS

(71) Applicants: Steve McLaughlin, York, PA (US); Seth McLaughlin, York, PA (US)

(72) Inventors: Steve McLaughlin, York, PA (US); Seth McLaughlin, York, PA (US)

( * ) Notice: Subject to any disclaimer, the term of this patent is extended or adjusted under 35 U.S.C. 154(b) by 0 days.

(21) Appl. No.: 14/716,256

(22) Filed: May 19, 2015

(65) Prior Publication Data

US 2015/0320292 A1 Nov. 12, 2015

Related U.S. Application Data

(63) Continuation of application No. PCT/US2012/000220, filed on Apr. 26, 2012, and a continuation of application No. 14/113,074, filed on Oct. 21, 2013, now Pat. No. 9,032,583.

(60) Provisional application No. 62/074,955, filed on Nov. 4, 2014.

(51) Int. Cl.

| | |
|---|---|
| ***A47L 23/24*** | (2006.01) |
| ***A43B 3/00*** | (2006.01) |
| ***A43B 23/26*** | (2006.01) |
| ***A43B 5/10*** | (2006.01) |
| ***A43C 19/00*** | (2006.01) |
| ***A47L 23/04*** | (2006.01) |
| ***A47L 23/28*** | (2006.01) |
| ***A43B 13/22*** | (2006.01) |

(52) U.S. Cl.

CPC ..... *A47L 23/24* (2013.01); *A43B 3/00* (2013.01); *A43B 5/10* (2013.01); *A43B 13/22* (2013.01); *A43B 23/26* (2013.01); *A43C 19/00* (2013.01); *A47L 23/04* (2013.01); *A47L 23/28* (2013.01)

(58) Field of Classification Search

CPC ..... A47L 23/24; A47L 24/04; A47L 23/28; A43B 3/00; A43B 5/10; A43B 13/22; A43B 23/26; A43C 19/00

See application file for complete search history.

(56) References Cited

U.S. PATENT DOCUMENTS

| | | | | |
|---|---|---|---|---|
| 4,019,216 | A * | 4/1977 | Priesemuth | B60S 1/38 15/250.03 |
| 4,823,426 | A | 4/1989 | Bragga | |
| 5,421,106 | A | 6/1995 | Emrick | |
| 5,471,768 | A | 12/1995 | Pryor | |
| 5,555,564 | A | 9/1996 | Welch | |
| 5,845,422 | A * | 12/1998 | Valteau, III | A43B 3/0078 36/136 |
| 5,930,920 | A * | 8/1999 | Arnold | A43B 5/001 15/210.1 |
| 6,128,801 | A | 10/2000 | Adzick et al. | |
| 2008/0190975 | A1 | 8/2008 | Naughton | |

* cited by examiner

*Primary Examiner* — Shay Karls

(74) *Attorney, Agent, or Firm* — Ober, Kaler, Grimes & Shriver; Royal W. Craig

(57) ABSTRACT

A traction-enhancing cleaning kit for allowing sports players to clean and dry the soles of their court shoes while in-play. The cleaning kit comprises a gellified shoe cleaning fluid, and a shoe-attachable cleaning and drying device comprising a gel-absorbent cleaning/drying cartridge removably secured by a clipping mechanism to a carrier platform, which is in turn secured along the forefoot of the sneaker by its laces. The cartridge includes an encapsulated viscose rayon microfiber panel backed by a moisture-impermeable layer, and held captive in a plastic frame. The frame includes a raised wiping lip surrounding the panel. In use, the player need only swipe one foot over the top of the cleaning and drying device attached to the other foot, brushing the sole. One swipe wets and squeegees dry, and the process is repeated for the other foot.

17 Claims, 4 Drawing Sheets

ANTI-SLIP SHOE ACCESSORY FOR COURT SPORTS

CROSS-REFERENCE TO RELATED APPLICATION(S)

The present application derives priority from U.S. Provisional Patent Application 62/074,955 filed Nov. 4, 2014, and is a continuation of PCT Application No. PCT/US2012/000220, filed Apr. 26, 2012, and of U.S. application Ser. No. 14/113,074 filed Oct. 21, 2013.

BACKGROUND OF THE INVENTION

1. Field of the Invention

The present invention relates to devices for improving the traction of sport shoes used on court surfaces and, more particularly, to an anti-slip shoe accessory for court sports such as basketball, volleyball, racquetball and the like which is worn on the shoes.

2. Description of the Background

It is well known that athletes require good footing and traction between their footwear and the playing surface to avoid injury and to perform at the highest level. Athletic shoes are designed to provide high traction between the sole of the shoe and the playing surface. Where the sole becomes dirty during play, its ability to provide traction to the player may be compromised.

For example, when playing basketball on a dusty court, a player might realize partway through a game that the dust is affecting traction. Even on clean surfaces, bad traction can lead to injury.

Traction may be restored by cleaning the sole of the shoe. This may seem like a simple affair. There are commercially available mats for shoes called Stick'Ums™. These may be placed on the basketball court sideline and players can step on them before or during the game. These mats have a top layer of adhesive-coated film that effectively removes dirt from shoes. The players simply step on the mat to remove dust. Alternatively, there are a variety of alcohol-based traction solutions available from sporting goods stores. These can be used to wet a towel which is placed on the sidelines so that players can wipe the bottom of their shoes. Though both of the foregoing can be accomplished in just moments, they require the player to return to court-side, forcing players to wait until short breaks in play. This is no solution to the problem during live play. Consequently, even professional basketball players are often seen licking their fingers while on the court and wiping the bottom of each shoe with their fingers. For obvious reasons physicians advise against this.

What is needed is a cleaning pad that can be secured to the shoe to provide a readily accessible cleaning element without the need to visit the sideline.

There have been a few past efforts toward this end.

For example, U.S. Pat. No. 4,823,426 to Bragga issued Apr. 25, 1989 discloses a Velcro™-attached shoe pad for dislodging, picking up and retaining foreign particles and other matter adhered on athletic footwear soles. The cloth pad relies on mechanical brushing to clean.

U.S. Pat. No. 5,421,106 to Emrick issued Jun. 6, 1995 discloses a removable shoestring cover for athletic shoes which provides an upwardly facing wiping surface of suede or other material, and which cover is attached to the shoestrings at the upper and lower edge of the cover by flaps which fold around portions of the shoestrings and are held by a hook and loop type fastener.

U.S. Pat. No. 5,471,768 to Pryor issued Dec. 5, 1995 discloses a sneaker with a built in atomizer for improved traction.

U.S. Pat. No. 5,555,564 to Welch discloses a shoe sole wiping pad sewn to the outer surface of an athletic sock. The wiping pad has a moisture-bearing wiping surface that removes dust and debris from the sole of an athletic shoe. The wiping pad cannot be removed from the sock for moisture replenishment.

U.S. Pat. No. 6,128,801 to Adzick et al. issued Oct. 10, 2000 discloses a shoe sole cleaner that removes debris from a sole of a user's shoe by swiping the sole over the shoe sole cleaner on the user's opposing shoe. A two-part mechanical fastener (e.g., hook-and-loop) secures the shoe sole cleaner to a shoe by its shoe laces. Again, the cloth pad relies on mechanical brushing to clean.

U.S. patent application Ser. No. 12/106,410 by Naughton filed Apr. 21, 2008 discloses a wearable wipe unit essentially comprising a Velcro™ attached towel.

Although the foregoing references are attached to the shoe or sock and can be used during game play, they primarily rely on mechanical brushing and are not very effective. A cleaning fluid is the most effective traction enhancer. However, simply impregnating a cleaning pad and attaching to a sneaker results in a relatively heavy device when worn, impedes quickness. Moreover, any wetted or impregnated pad will tend to leave a residue on the soles, temporarily reducing traction. Even worse, the fluids can leach, spray or splatter during the game, resulting in wet shoes and socks. Even worse, the devices can leave moisture on the court and create substantial safety issues. What is needed is a lightweight low-profile cleaning pad assembly that can be removably secured to the shoe, designed to entrap a semi-solid gel cleaner which avoids leaching, spraying or splattering of the gel.

SUMMARY OF THE INVENTION

It is, therefore, an object of the invention to provide a gel-impregnated cleaning pad for court shoes that is worn on the shoes and is extremely light weight (4 ounces or less) so as not to impede performance.

It is another object to provide a court-shoe cleaning pad as above that can be easily secured to the shoe to provide a readily accessible gel-cleaning element.

It is another object to provide a court-shoe cleaning pad as above that provides a readily accessible gel-cleaning and sequential drying element, e.g., a specially-designed gel-retaining pad within an encapsulating sneaker-attached cartridge that surrounds the pad with an integral wiping lip.

It is another object to provide a combination semi-solid (gellified) cleaner in combination with a specially-designed gel-absorbing cleaning pad to avoid leaching, spraying or splattering of the gel.

It is another object to provide a gel-absorbent court-shoe cleaning pad that is firmly secured to the shoe during play, yet easily removable for gel-replenishment or laundering.

In accordance with the foregoing objects, the present invention provides a combination kit including a particular gellified shoe cleaning fluid, a gel-retentive absorbent sole cleaning assembly, and an anchoring platform that can be secured to a shoe for removably attaching the sole cleaning assembly thereto. The sole cleaning assembly can be impregnated with the cleaning gel to provide a readily accessible court-shoe sole cleaning solution during game play without the need to visit the sideline. The combination of materials used for the shoe cleaning gel and for the gel-absorbent sole cleaning assembly avoids evaporation of the gel during play, and also avoids leaching, spraying or splattering of fluid during the game. The sole cleaning assembly includes a cleaning pad seated in a cartridge that is removably attached to a carrier platform. The carrier platform is laced to the shoes. The cleaning pad is a raised (e.g., upwardly convex) gel-absorbent pad, and the cartridge provides a surrounding plastic frame for constraining the pad so that the wearer need only swipe the other sneaker sole across it. In a preferred embodiment the cleaning pad comprises a non-woven microfiber layer attached to a moisture-impermeable base layer, the two layers being held captive inside the surrounding frame of the cartridge. In an embodiment, the plastic frame is rectilinear, though it may be ovoid or elliptical, or may have a different shape. The plastic frame surrounds the cleaning pad, which is similarly-shaped. The cleaning pad may be sewn and/or adhered inside the plastic frame. The base layer is formed with a central elevation running centrally lengthwise along its major axis, which underlies the microfiber layer and elevates it slightly above the surrounding plastic frame. The surrounding plastic frame of the cartridge is formed with a raised wiper lip surrounding the cleaning pad. This way, when a shoe sole is brushed across the gel-wetted cleaning pad any residual gel is wiped clean by the raised wiper lip. The plastic frame slides lengthwise into an anchoring platform which is laced to the user's sneaker, and removably latches in place. This allows the sole cleaning assembly to be removably attached along the forefoot of the sneaker via the platform so that it can be removed for easier gel-replenishment and/or cleaning.

In use, with the cleaning pad impregnated with gel cleaner and the entire sole cleaning assembly removably attached to the forefoot of the sneaker via the anchoring platform, the user simply brushes the sole of his opposing sneaker over-top/against the sole cleaning assembly. The entire length of the sole makes rubbing contact transversely across it, chemically cleaning the sole with the wiper lip of the frame immediately wiping excess or residue back into the absorbent pad. The process is repeated for the other foot. The device is remarkably effective at cleaning the soles of court-shoes and significantly improves traction. Moreover, the device is very lightweight (2-3 oz per foot), and can be used on-court anytime without the need to visit the sideline. The sequential fluid-cleaning and wiping/drying avoids leaving any residue on the shoes, and the combination of gellified cleaning fluid, gel-absorbing cleaning pad, and encapsulating frame avoids leaching, spraying or splattering of the gel fluid during play, all of which improves court safety.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

Reference will now be made in detail to preferred embodiments of the present invention, examples of which are illustrated in the accompanying drawings. Wherever possible, the same reference numbers will be used throughout the drawings to refer to the same or like parts. The present invention is a combination kit, including a particular gellified shoe cleaning fluid, and gel-absorbent court-shoe cleaning and drying device that can be secured to the shoes to provide a readily accessible sole-cleaning and drying solution during game play, to improve traction without the need to visit the sidelines.

Figure 1:
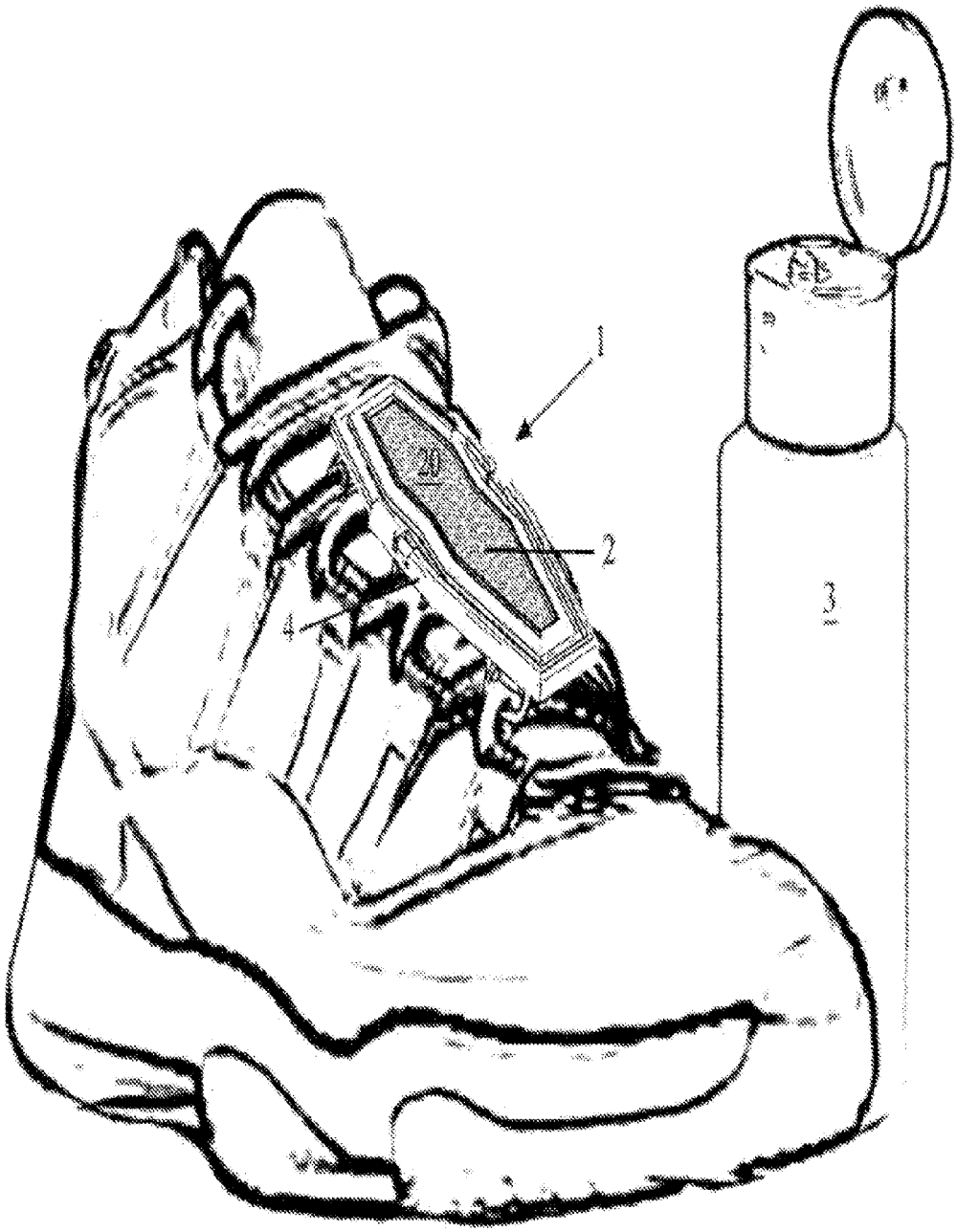
FIG. 1 is a perspective illustration of a basketball court-shoe with a gel-absorbing court-shoe cleaning and drying device attached thereto in accordance with an embodiment of the invention.

FIG. 1 is a perspective illustration of a basketball court-shoe with a gel-absorbing court-shoe cleaning and drying kit in accordance with a first embodiment of the invention. The kit includes both a dropper vial 3 of gellified shoe cleaning fluid, plus a cleaning/drying device 1 that uses the cleaning gel. The cleaning/drying device 1 further includes a cartridge 2 that is removably attached atop a carrier platform 4 which is in turn attached to the shoe laces. The cleaning/drying cartridge 2 includes a gel-absorbent fabric pad 20 impregnated with the cleaning gel from dropper vial 3. The combination of materials used for the shoe cleaning gel and fabric pad 20, as well as the design details of the cleaning/drying cartridge 2, encapsulates the gel during play and avoids evaporation, as well as leaching, spraying or splattering of gel during the game.

The dropper vial 3 is a commercially available flip-top plastic dropper vial. Vial 3 is preferably filled with a gel-viscosity glycerin/ethanol gel soap and tackifier solution consisting essentially of water, denatured alcohol, glycerin compound, gellifier(s), optional benzoic acid, plus fragrance and coloring agent(s) as a matter of design choice. The presently-preferred embodiment comprises 1 part glycerin, 1 part denatured alcohol, 3 parts water, gellifier, food coloring, and a bitter additive such as denatonium benzoate to deter anyone from drinking it. If desired, the benzoic acid may be added as an antimicrobial preservative. Glycerine also has an antibacterial potential, which alone or in combination with the benzoic acid has an added biocidal advantage. Basketballs and the courts that they touch, as well as the shoes that contact the court, are all well-known bacterial hotbeds. The preferred gellifier for the foregoing is polyacrylic acid added to reach a viscosity of between 5000-15000 cP, which is best suited for absorption into the fabric pad 20. Vegetable gums (agar, pectin, alginates, etc.) are possible alternative gellifiers. An alternative gel soap and tackifier solution may comprise polyethylene glycol (PEG) or methoxypolyethylene glycol (mPEG) cleaner, or other suitable PEG/mPEG detergents available from Dow Chemical under the trademark Carbowax™. Note that whether PEG, mPEG, glycerine cleaner, or some combination is used, these compounds are well-suited because they are completely non-toxic and non-acidic, and cannot harm court floors.

Figure 2:
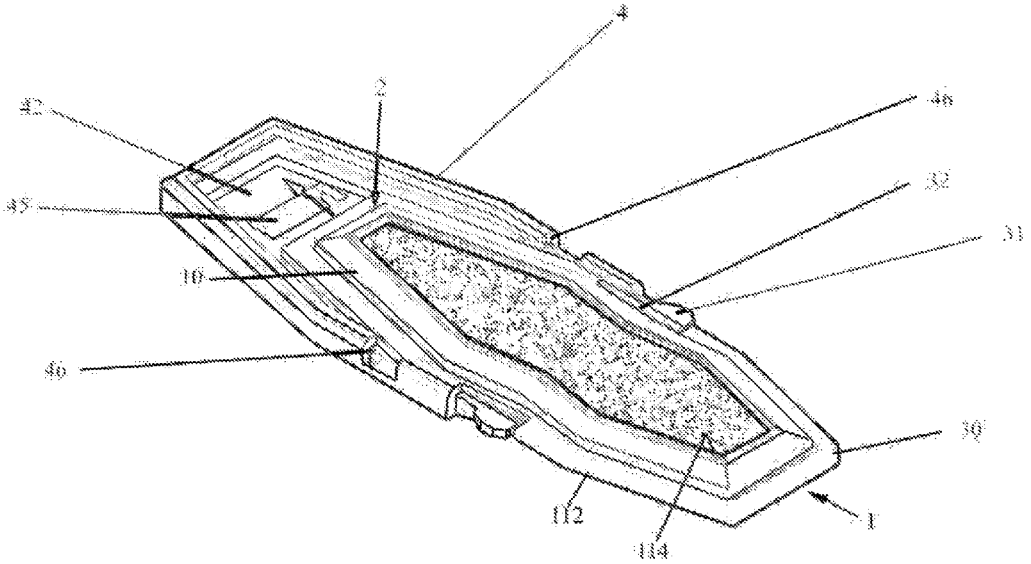
FIG. 2 is a perspective illustration of the court-shoe cleaning and drying device 1 with gel-absorbing court-shoe cleaning and drying cartridge 2 shown partially inserted into its underlying attachment platform 4.

FIG. 2 is a perspective illustration of the cleaning/drying device 1 according to a first embodiment of the present invention comprising the elongate carrier platform 4 which is laceable to the shoe lengthwise extending down the forefoot, and the court-shoe cleaning/drying cartridge 2 partially inserted lengthwise into the carrier platform 4. The cleaning/drying cartridge 2 includes a plastic frame 10 encapsulating the absorbent fabric pad 20. As will be described, fabric pad 20 is preferably a non-woven micro-fiber layer backed by a moisture-impermeable layer and held captive inside the surrounding plastic frame 10. In the present embodiment, the plastic frame 10 is elongate rectilinear, preferably hexapodal as shown, but may alternatively be substantially ovoid or elliptical. Frame 10 surrounds the absorbent fabric pad 20, which is similarly-shaped. The absorbent fabric pad 20 may be sewn and/or adhered inside the plastic frame 10.

In use, the cleaning pad 20 is impregnated with gel cleaner from vial 3 and the entire sole cleaning assembly 1 is removably laced along the forefoot of the sneaker, approximately over the second and third metatarsal bones, by tying the anchoring platform 4 to the laces as seen in FIG. 1. The device 1 is self-aligned along the forefoot of the sneaker and the user simply brushes the sole of his opposing sneaker overtop/against the sole cleaning assembly. The entire length of the sole makes rubbing contact transversely across it, chemically cleaning the sole and scraping excess or residue back into the absorbent pad 20 as described below. Two such devices may be worn (one per shoe) so that the process may be repeated for the other sole. Each device 1 is remarkably effective at cleaning the sole of the opposing court-shoe and significantly improves traction. Moreover, each device 1 is very lightweight (2-3 oz per foot), and can be used on-court anytime without the need to visit the sideline. The sequential fluid-cleaning and wiping/drying avoids leaving any residue on the shoes, and the combination of gellified cleaning fluid 3, gel-absorbing cleaning pad 20, and encapsulating frame avoids leaching, spraying or splattering of the gel fluid during play, all of which improves court safety.

Figure 3:
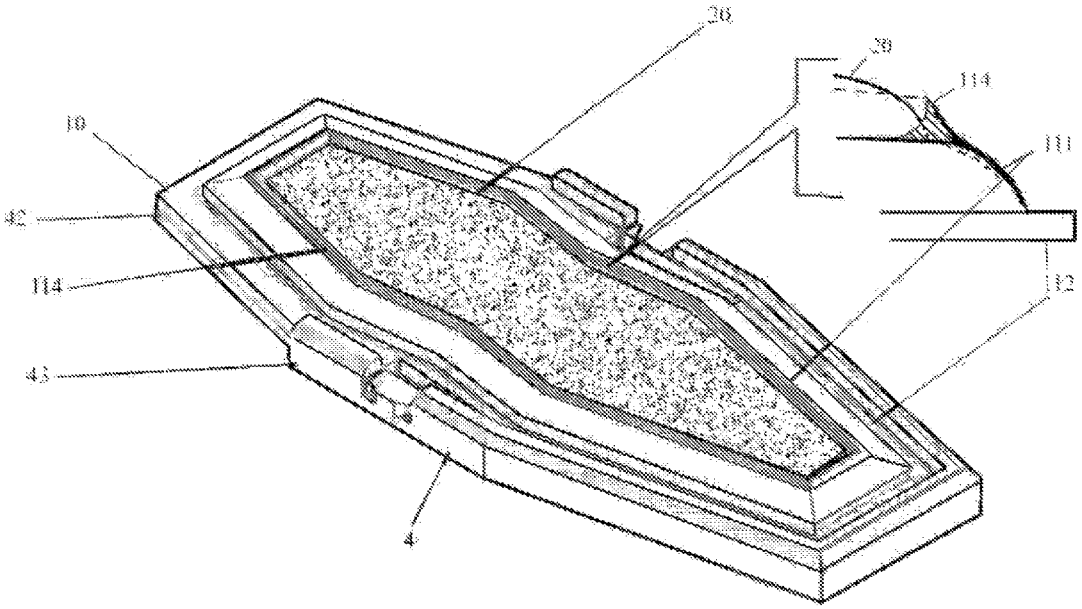
FIG. 3 is a perspective illustration of the court-shoe cleaning and drying device 1 with gel-absorbing court-shoe cleaning and drying cartridge 2 shown fully inserted into its underlying attachment platform 4.

FIG. 3 is a perspective illustration of the of the court-shoe cleaning and drying device 1 with gel-absorbing court-shoe cleaning and drying cartridge 2 shown fully inserted into its underlying attachment platform 4. The illustrated hexapodal configuration achieves the requisite anchoring stability with a low number of shoelace anchor points (two as will be described), thereby reducing the weight and bulk of the platform 4.

The surrounding plastic frame 10 is formed as a rigid open-faced structure with raised side walls 1 (also see inset of FIG. 3) that surround and enclose the exposed edges of the absorbent fabric pad 20, leaving a majority of the absorbent fabric pad 20 exposed there through. The side walls 111 of frame 10 run to a moisture-impermeable floor 112 that provides a lateral surface for seating and constraining the fabric pad 20. The floor 112 protrudes outward slightly beyond the walls 11 to define a horizontal flange that keys into and centers the frame 10 atop platform 4. As described below the absorbent pad 20 may optionally be sewn to and/or bonded to the floor 112 beneath the frame 10, although closely confining the pad 20 within the cavity of the floor 112 and sidewalls Ill tends to provide ample restraint.

As best seen in the inset of FIG. 3, the surrounding plastic frame 10 is formed with a raised wiper lip 114 atop the sidewalls 111 and surrounding the entire cleaning pad 20. Wiper lip 114 comprises a raised wall surrounding the entire frame 10 and extending a scraping edge over the sides of the cleaning pad 20. This way, as a shoe sole is brushed across the cleaning pad 20 any gel deposited onto the shoe sole is scraped off by wiper lip 114 and reabsorbed back into the cleaning pad 20. This avoids messy over-wetted soles and conserves gel.

Figure 4:
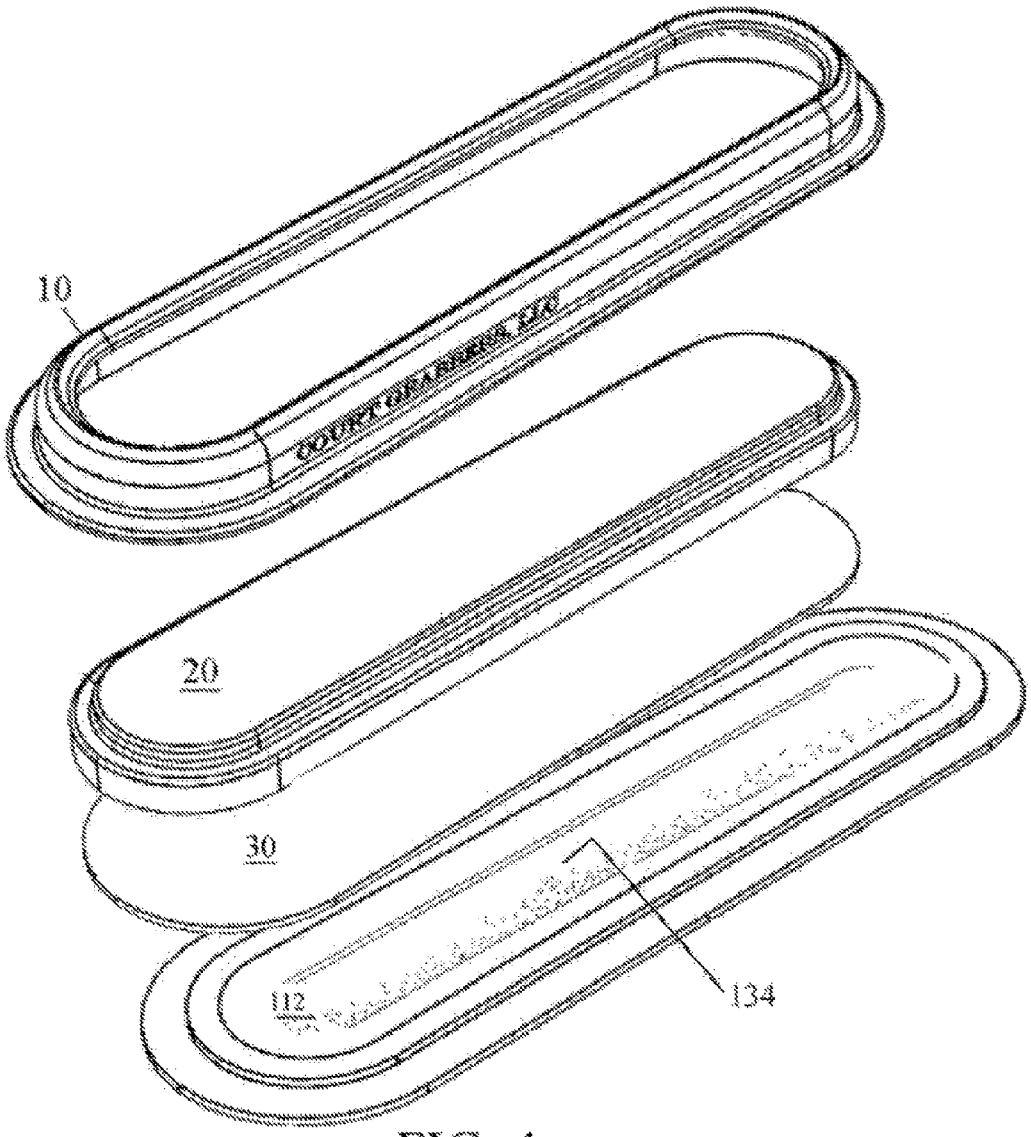
FIG. 4 is an exploded perspective view of the various components and layers of the court-shoe cleaning and drying device 1.

FIG. 4 is an exploded perspective view of the cleaning/drying cartridge 2 of FIGS. 2-3 configured in an ovoid shape. The frame 10 inclusive of side walls 111 and wiper lip 114 may be formed as a separate molded component, and may be sewn, bonded or welded to the moisture-impermeable floor 112 sandwiching and constraining the fabric pad 20 there between. Again, the floor 112 protrudes outward slightly beyond the walls 111 to define a horizontal flange that keys into and centers the frame 10 atop platform 4 (see FIG. 2). In each embodiment, the shape of frame 10 and platform 4 are chosen to correspond to the shape of cleaning pad 20. As shown in FIG. 4, the cleaning/drying cartridge 2 comprises the absorbent fabric pad 20 sandwiched between the surrounding frame 10 and floor 112. The absorbent fabric pad 20 comprises a non-woven viscose rayon/cellulose panel cut/formed in the preferred shape; in the embodiment shown in FIG. 4, the pad 20 has an elongate rectangular or oblong/ovoid shape. Specifically, pad 20 is a super absorbent shammy-type cloth of 80% viscose and 20% polyester, cut from a 0.317-0.635 cm (⅛-¼") thick cloth blank for proper gel-carrying capacity, into the preferred shape, in this case a 3-4" long by 0.75-1.5" wide oblong section. In addition, the cloth preferably has a gsm weight of 260 within an acceptable range of from 200-300.

What is necessary in each embodiment is that the top-to-bottom dimension of the cleaning/drying pad 20 equal or exceed the breadth of the shoe sole, which is approximately 3.5". In the illustrated embodiment, the absorbent fabric pad 20 comprises a section of non-woven viscose rayon/cellulose cloth 3" long and 1.5" wide. If desired, the absorbent fabric pad 20 may be silkscreened with team or corporate logos, or other branding indicia.

The waterproof floor 112 prevents the gel from migrating out of the pad 20, and in conjunction with the surrounding plastic frame 10 essentially encapsulates the fabric pad 20 so that gel cannot leach out. Optionally, the absorbent fabric pad 20 may be sewn and/or adhered to a like-shaped waterproof backing layer 30 which prevents leaching of the gel cleaner into the frame 10.

In the preferred embodiment the floor 112 is preferably molded to retain a convex configuration, with a raised surface feature 134 defining a hump or other protrusion. This way, when underlying the absorbent fabric pad 20, the raised surface feature 34 elevates the fabric pad 20 above the surrounding frame 10 thereby ensuring that when a sneaker sole is swiped across the device 1 it makes firm contact with the raised surface of the fabric pad 20 and is fully exposed to the gel absorbed therein. The raised surface feature 34 (convex bubble or ridge) may be molded into the floor 112.

Figure 5:
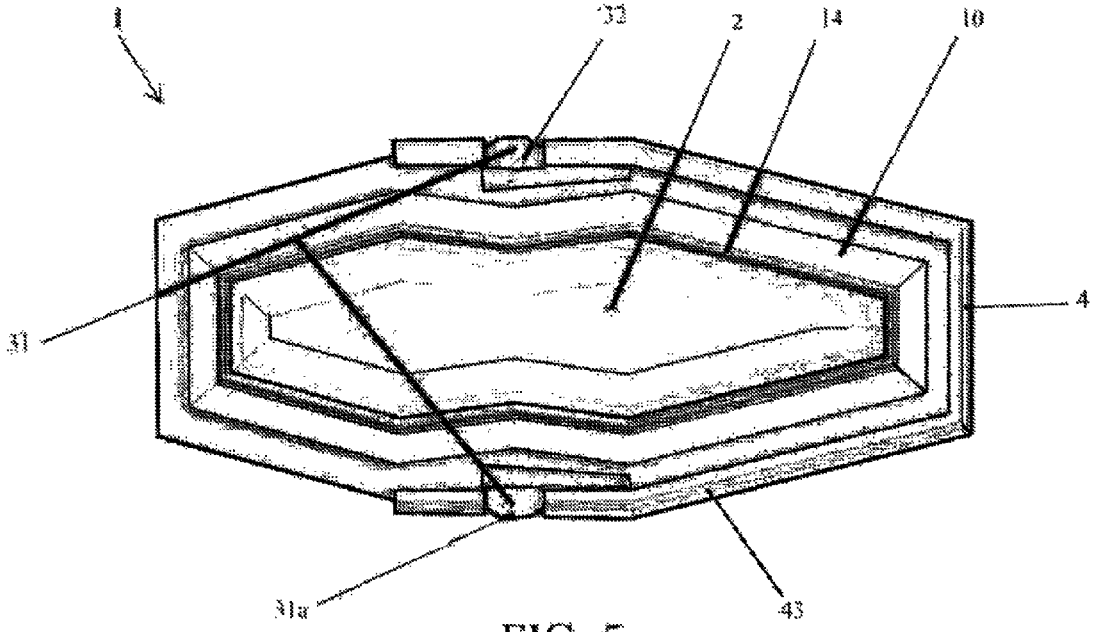
FIG. 5 is an overhead perspective illustration of the carrier platform 4 illustrating the hexapod configuration.

With reference to the top view of FIG. 5 and to FIGS. 2 and 3, cleaning/drying cartridge 2 slides endlong into platform 4, is retained therein by a tongue-and-groove fit of the flange within platform 4, and is removably secured to platform 4 by a latching mechanism as will be described. Platform 4 comprises a substantially flat plastic member having a surface 42 formed in substantially the same shape as frame 10 and pad 20 and having a plurality of stirrups 44 protruding downward from the back surface for receiving the laces of the shoe as will be described.

Platform 4 is formed with opposing raised edges 43 surrounding a majority of platform 4, but leaving one end open-ended. The edges 43 furl inward to define an overhang for tongue-and-groove fit of the flange within platform 4, but the edges 43 are interrupted by apertures 46 for receiving spring fingers 31 on the cleaning/drying cartridge 2 as described below. Specifically, raised edge 43 borders both long edges of platform 4 parallel to its major axis, and one short edge of platform 4 perpendicular to its major axis. The remaining short edge of platform 4 is not raised to allow cartridge 2 to slide horizontally (as shown by the arrows in FIG. 2) with respect to platform 4 on-and-off of platform 4 as necessary to remove cartridge 20 for cleaning, laundering, replacement, etc. of pad 20, frame 10 or moisture-proof backing 30. Where pad 20, frame 10, floor 112 and platform 4 are shaped generally as an elongate octagon as shown in FIGS. 1-3 and 5-6, as opposed to an elongate ovoid as in FIG. 4, the raised edge 43 on long sides of platform 4 may terminate at some partial distance along the long edges of platform 4 away from short edge raised edge 43 and at a widest point of cartridge 2 to allow cartridge 2 to slide horizontally off of platform 4 as shown in FIG. 2.

Figure 6:
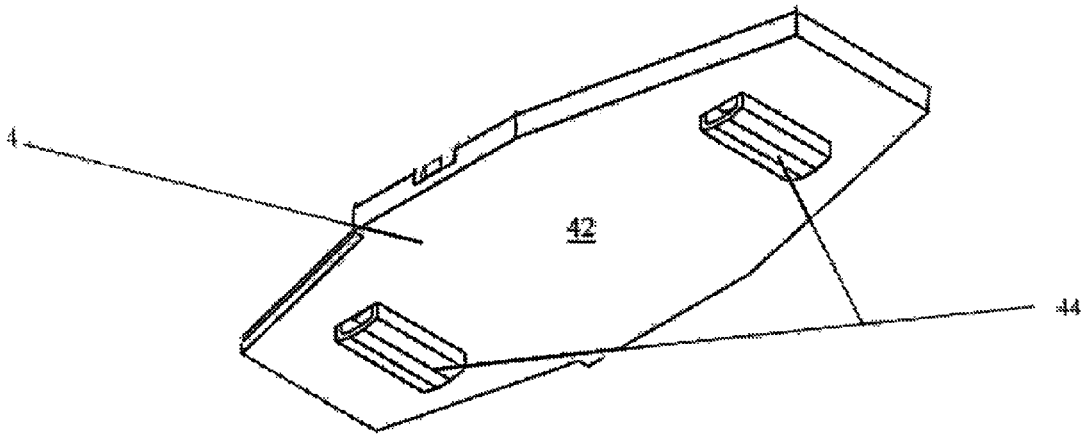
FIG. 6 is a bottom perspective illustration of the cleaning/drying device 1.

FIG. 6 is a bottom perspective illustration of the platform 4 illustrating a preferred stirrup 44 configuration well suited for accommodating the wide variety of court shoes which include shoes with eyelets and lugs instead of eyelets. A typical sneaker will have a horizontal lace spacing of 50 mm and a criss-cross pattern with five pairs of eyelets or lugs, though both spacing and lugs/eyelets will vary. Moreover, players often lace the shoe in a direct horizontal pattern avoiding a criss-cross configuration. The stirrups 44 of the present embodiment comprise fore and aft molded lateral channels defining 1/16-1/8"apertures. The stirrups 44 protrude downward to a flat reinforced contact surface so that the platform 4 is elevated approximately 1/4" above the laces and sits atop the sneaker squarely along the forefoot. In the illustrated embodiment there are two stirrups 44 flanking both ends of the platform 4. Each stirrup 44 comprises an integrally molded plastic passage protruding downward and laterally across the platform 4. The trough-shaped stirrups 44 extend downward from the underside of platform 4 to receive laces of the wearer's shoe for securing the device 1 to the wearer's shoe. Trough-shaped stirrups 44 are preferably perpendicular to the main axis of platform 4 to best receive shoelaces when the shoe is laced in a horizontal fashion, as shown in FIG. 6. However, two or more stirrups 44 may be included and stirrups 44 may be oriented in any direction (i.e. diagonally relative to the main axis of platform 4 to accept cross-laced shoe laces) according to design preference. Optionally, the area above stirrups 44 is an opening 45 to make the process of threading shoelaces through stirrups 44 easier and to reduce the overall weight of the device 1.

The latching mechanism by which cartridge 2 is secured onto platform 4 is now described with reference to FIGS. 2 and 5. The protruding flange of the moisture-proof floor 112 of cleaning/drying cartridge 2 is formed with two opposing spring fingers 31 including a corresponding notch 32. As shown in FIG. 5, when cartridge 2 is securely fitted onto platform 4, spring fingers 31 are outwardly biased and displaced from the main body of cartridge 2 by corresponding notch 32. The shape of notches 32 correspond to the shape of spring fingers 31 such that, upon the application of pressure (by, i.e., a player's finger), spring fingers 31 can move laterally to fit completely inside of the corresponding notch 32 such that cartridge 2 can slide onto platform 4 beneath raised edges 43. When cartridge 2 is fully inserted and properly positioned in platform 4, spring fingers 31 snap outward such that a bulbous portion 31*a* of each clip 31 fits into the corresponding aperture 46 in frame 4 to secure cleaning/drying cartridge 2 on platform 4. Apertures 46 are preferably positioned in the lengthwise middle of platform 4 to provide the most secure attachment points for cartridge 2, and such that raised edges 43 extends along the sides of platform 4 until at least the position of apertures 46 as shown in FIG. 5.

In use according to the present embodiment, and referring back to FIG. 1, a player detaches the cleaning/drying cartridge 2 from the carrier platform 4 and applies a single line of gel from container 3 along the exposed fabric pad 20. The cleaning/drying cartridge 2 is then inserted into the carrier platform 4 and latched in place as described above so that it extends lengthwise along the top of the foot. The gel quickly absorbs and is entrapped within the fabric pad 20 bounded by the waterproof backing 30 and the surrounding moisture-proof frame 10. During play, the player need only swipe each foot once over the top of the cleaning/drying pad attached to the other foot, brushing the sole against the cleaning/drying pad. The entire length of the foot makes rubbing contact transversely across the fabric pad 20 and is fully exposed to the gel absorbed therein, and residual gel adhered to the sneaker sole is wiped free by wiper lip 114. The process may be repeated for the other foot.

The sequential fluid-cleaning and drying is remarkably effective at cleaning the soles of both shoes and significantly improves traction. Simply wiping a sole on a glycerin-impregnated towel leaves a fluid residue that quickly picks up dust and dirt during play, defeating its own purpose. However, wiping followed by immediate drying avoids this. Moreover, immediate drying avoids splattering of any residue onto the shoes, and the encapsulation within frame 10 avoids leaching, spraying or splattering of the gel fluid during play, all of which improves court safety. The gel viscosity and thickness of the cleaning and drying pad 20 is calculated to maintain moisture and effectiveness for a complete basketball game. When it becomes necessary to replenish the gel or launder the cleaning and drying pad 20, it can be conveniently removed by pulling it off the attachment platform 4.

It should now be apparent that the above-described invention provides an effective anti-slip shoe accessory for cleaning the soles of court shoes such as basketball, volleyball, racquetball and other shoes, which is worn on the shoes for on-demand use even during play, without the need to visit the sideline. The gel cleaner and thick, absorbent viscose rayon/cellulose panel 20 encapsulated in a waterproof frame 10 avoids leaching, spraying or splattering of the gel even during active play, improving traction and court safety. Moreover, the biocidal nature of the gel improves sanitary conditions. Those skilled in the art will understand that various modifications and variations can be made in the present invention without departing from the spirit or scope of the invention. It is to be understood, therefore, that the invention may be practiced otherwise than as specifically set forth in the appended claims.

We claim:

1. An apparatus for cleaning a sole of a court shoe, comprising:

a carrier platform having an elongate flat supporting surface and a plurality of stirrups protruding from said platform for lacing said carrier platform to a forefoot of one shoe of a pair of court shoes;

a cleaning and drying cartridge removably attached to said carrier platform lengthwise along the forefoot of said court shoe, said cleaning and drying cartridge further comprising a recessed frame surrounded by a raised wiper lip, and an absorbent cleaning pad held captive in said frame and surrounded by said wiper lip, said cleaning pad being configured for absorbing and retaining a cleaning and tackifier solution.

2. The apparatus for cleaning a court-shoe sole according to claim 1, wherein the cleaning and drying cartridge of said carrier platform comprises a water-impermeable floor.

3. The apparatus for cleaning a court-shoe sole according to claim 1, wherein the wiper lip of said cleaning and drying cartridge surrounds an edge of the cleaning pad and is raised above the edge of the cleaning and pad to scrape residual gel from the sole of another of said pair of court shoes.

4. The apparatus for cleaning a court-shoe sole according to claim 1, wherein said plurality of stirrups comprise two stirrups protruding downward from said platform for lacing said carrier platform to a forefoot of one shoe of a pair of court shoes.

5. The apparatus for cleaning a court-shoe sole according to claim 4, wherein said two stirrups each comprise an elongate, trough-shaped passage protruding downward and laterally across said carrier platform.

6. The apparatus for cleaning a court-shoe sole according to claim 1, wherein said cleaning and drying cartridge is elongate for removable attachment to said carrier platform lengthwise along the forefoot of said court shoe oriented along the shoe forefoot.

7. The apparatus for cleaning a court-shoe sole according to claim 6, wherein said orientation along the shoe forefoot makes rubbing contact transversely to a sole dragged across it to both chemically clean the sole and scrape excess gel back into the absorbent pad.

8. The apparatus for cleaning a court-shoe sole according to claim 1, wherein said cleaning and drying cartridge is removably inserted lengthwise into said attachment platform.

9. The apparatus for cleaning a court-shoe sole according to claim 8, wherein said cleaning and drying cartridge includes one or more spring fingers and said platform comprises one or more latches for removably latching said cleaning and drying cartridge lengthwise into said attachment platform.

10. An apparatus for cleaning a sole of a court shoe, comprising:

an elongate carrier platform having an elongate flat supporting surface, inwardly-furled walls extending upward atop the carrier platform, and a plurality of attachment members protruding beneath said platform for lacing said carrier platform lengthwise along a forefoot of one shoe having a sole width Y;

a cleaning and drying cartridge removably attached to said carrier platform lengthwise along the forefoot of said court shoe, said cleaning and drying cartridge comprising a recessed frame surrounded by a raised wiper lip, and an absorbent cleaning pad of length W equal to or greater than the sole width Y the wiper lip of said cleaning and drying cartridge surrounding an edge of the cleaning pad being raised above the edge of the cleaning pad to scrape residual gel from the sole of another of said pair of court shoes.

11. The apparatus for cleaning a court-shoe sole according to claim 10, wherein the cleaning and drying cartridge of said carrier platform comprises a water-impermeable floor.

12. The apparatus for cleaning a court-shoe sole according to claim 10, wherein said plurality of attachment members comprise stirrups protruding downward from said platform for lacing said carrier platform to a forefoot of one shoe of a pair of court shoes.

13. The apparatus for cleaning a court-shoe sole according to claim 10, wherein said cleaning and drying cartridge is elongate for removable attachment to said carrier platform lengthwise along the forefoot of said court shoe oriented along the shoe forefoot.

14. The apparatus for cleaning a court-shoe sole according to claim 10, wherein said orientation along the shoe forefoot makes rubbing contact transversely to a sole dragged across it to both chemically clean the sole and scrape excess gel back into the absorbent pad.

15. The apparatus for cleaning a court-shoe sole according to claim 10, wherein said cleaning and drying cartridge is removably inserted lengthwise into said attachment platform.

16. The apparatus for cleaning a court-shoe sole according to claim 10, wherein said cleaning and drying cartridge includes one or more spring fingers and said platform comprises one or more latches for removably latching said cleaning and drying cartridge lengthwise into said attachment platform.

17. The apparatus for cleaning a court-shoe sole according to claim 10, wherein said absorbent cleaning pad has an upwardly convex upper surface.

* * * * *